United States Patent [19]

Velarde et al.

[11] 3,940,841

[45] Mar. 2, 1976

[54] CLIPPER APPARATUS FOR ATTACHING MATERIAL TO A BROOMSTICK OR THE LIKE

[75] Inventors: Clyde R. Velarde, Raleigh, N.C.; Henry G. Williams, Mount Olive, Ala.

[73] Assignee: Rheem Manufacturing Company, New York, N.Y.

[22] Filed: Feb. 18, 1975

[21] Appl. No.: 550,550

[52] U.S. Cl. ..... 29/243.56
[51] Int. Cl.[2] ..... B23P 11/00
[58] Field of Search ..... 29/243.56, 243.52

[56] References Cited

UNITED STATES PATENTS

| | | | |
|---|---|---|---|
| 3,133,288 | 5/1964 | Ohgren | 29/243.56 |
| 3,160,890 | 12/1964 | Lefebvre | 29/243.56 X |
| 3,810,495 | 5/1974 | Pack | 29/243.56 |

*Primary Examiner*—James L. Jones, Jr.
*Attorney, Agent, or Firm*—Molinare, Allegretti, Newitt & Witcoff

[57] ABSTRACT

An apparatus for attaching material to a rod, such as yarn to a broomstick to form a mop, comprises means for fastening the material to the rod with a metal clip. The clip attachment means includes a punch for driving the clip down a guide channel and into contact with a die to form the clip about the material and rod. The guide channel is formed in part by opposed pivotal parallel gates driven by gate actuators. The gates are closed by the same mechanism that drives the clip punch.

10 Claims, 18 Drawing Figures

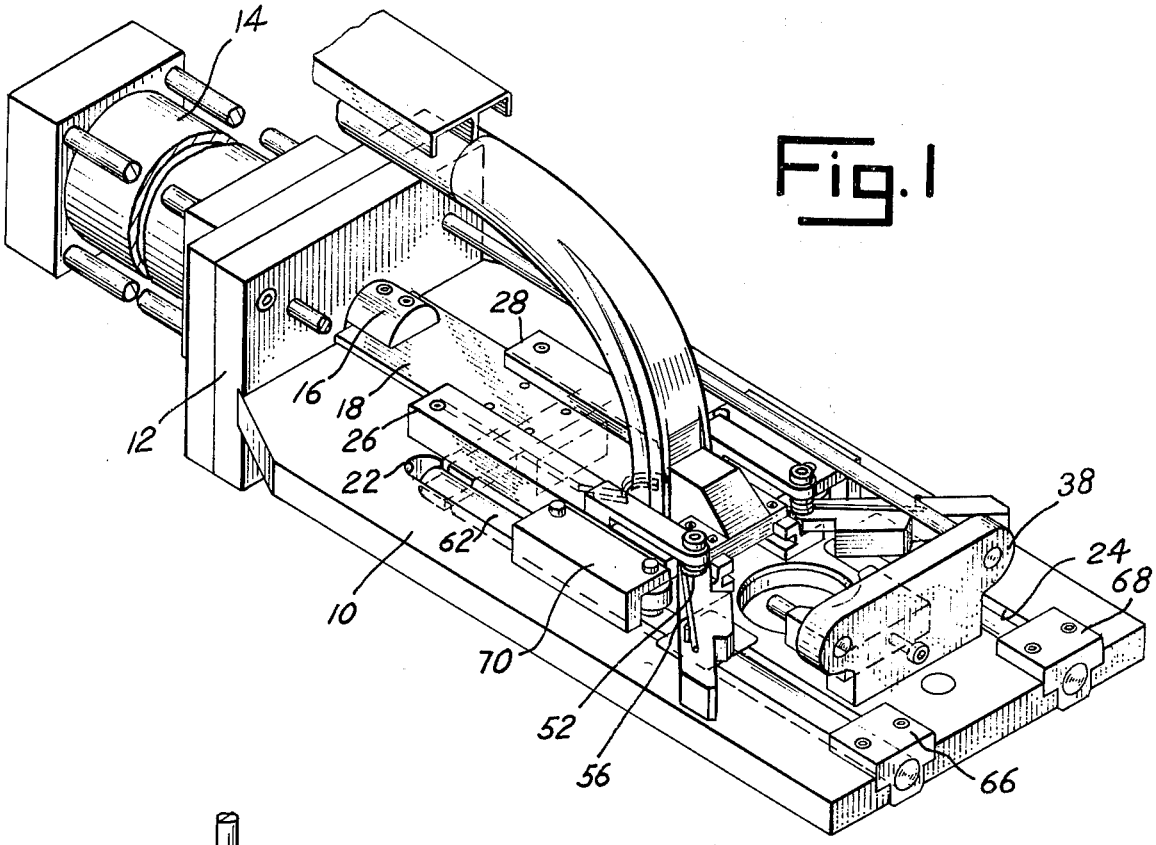
Fig. 1
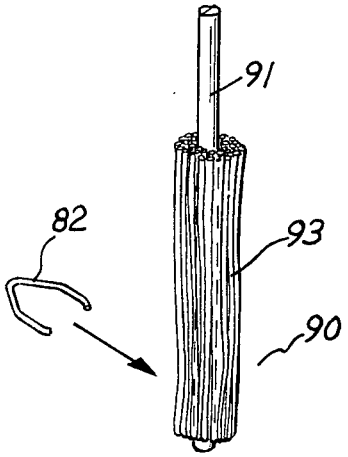
Fig. 2
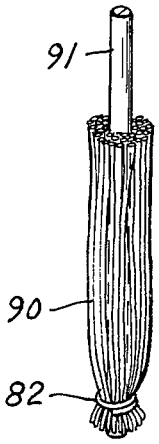
Fig 3
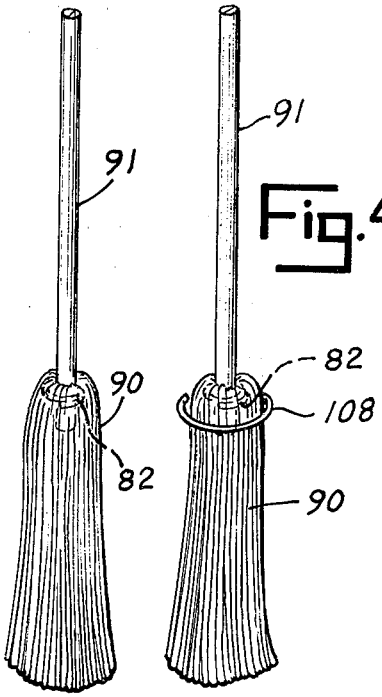
Fig. 4A
Fig. 4

CLIPPER APPARATUS FOR ATTACHING MATERIAL TO A BROOMSTICK OR THE LIKE

BACKGROUND OF THE INVENTION

This invention relates to a clip apparatus and method for attaching a generally large clip about a substantially incompressible rod-like member. The apparatus of the present invention has particular utility for attaching yarn, broom straw, or the like, to a broomstick. There are, however, many additional applications for such an apparatus. In general, therefore, the apparatus is designed to attach a clip about a mass of material wherein at least a portion of the mass is substantially incompressible.

Previously, the attachment of yarn or the like to a broomstick, for example, was accomplished by means of a hand assembly operation including wrapping wire, cord, or the like around the yarn and broomstick. Alternatively, the wire wrapping operation could be accomplished by some type of wrapping machinery. Such procedures are both time consuming and relatively expensive. Moreover, the cost of the wrapping materials is not insignificant. In order to overcome various difficulties associated with prior art manufacturing methods and apparatus, the present application teaches how a single metal clip may be utilized in place of wire or cord to attach loose material to a rod.

SUMMARY OF THE INVENTION

In a principal aspect, the present invention comprises an apparatus for attaching a clip about a generally rod-like mass at least a portion of that mass being substantially incompressible. The apparatus comprises a mounting plate with an opening for receipt of the mass. Punch means are mounted on the plate for reciprocation toward and away from the opening as directed by a guideway. A die is also provided to direct attachment of the clip about the mass. The guideway for the clip is formed, in part, by opposed gates on opposite sides of the opening. The gates are closed by gate actuators which are mounted for operation in conjunction with the operation of the punch.

It is thus an object of the present invention to provide an improved clipping mechanism which may be used for attaching a clip about a generally incompressible mass.

It is a further object of the present invention to provide a clipping apparatus which includes a punch, a die and opposed gate members forming a clip guideway about an opening so that the clip may encircle the material in the opening and become attached firmly about that material.

Another object of the present invention is to provide a novel clip which may be used in combination and cooperation with the improved clip apparatus of the present invention for attaching and holding a mass of material.

Still another object of the present invention is to provide a clip apparatus capable of attaching a single clip about a rod-like member where the diameter of the clip as attached is greater than shown by the prior art.

One further object of the present invention is to provide a novel combination of elements capable of cooperating with a unique clip to position and attach that clip about a mass of material.

These and other objects, advantages and features of the invention will be set forth in greater detail in the description which follows.

DESCRIPTION OF THE DRAWING

In the detailed description which follows reference will be made to the drawing comprised of the following Figures:

FIG. 1 is a perspective view of the apparatus of the present invention;

FIG. 2 is a perspective view illustrating one step in the method of practicing the present invention by providing attachment of a clip about a combination of yarn and a broomstick to form a mop;

FIG. 3 is the next sequential step in the manufacture of a mop utilizing the apparatus of the present invention;

FIG. 4 illustrates one embodiment of the finished product manufactured by the process utilizing the apparatus of the present invention;

FIG. 4A illustrates another embodiment of a product made in accordance with the process and product of the present invention;

DESCRIPTION OF THE PREFERRED EMBODIMENT

Figure 5:
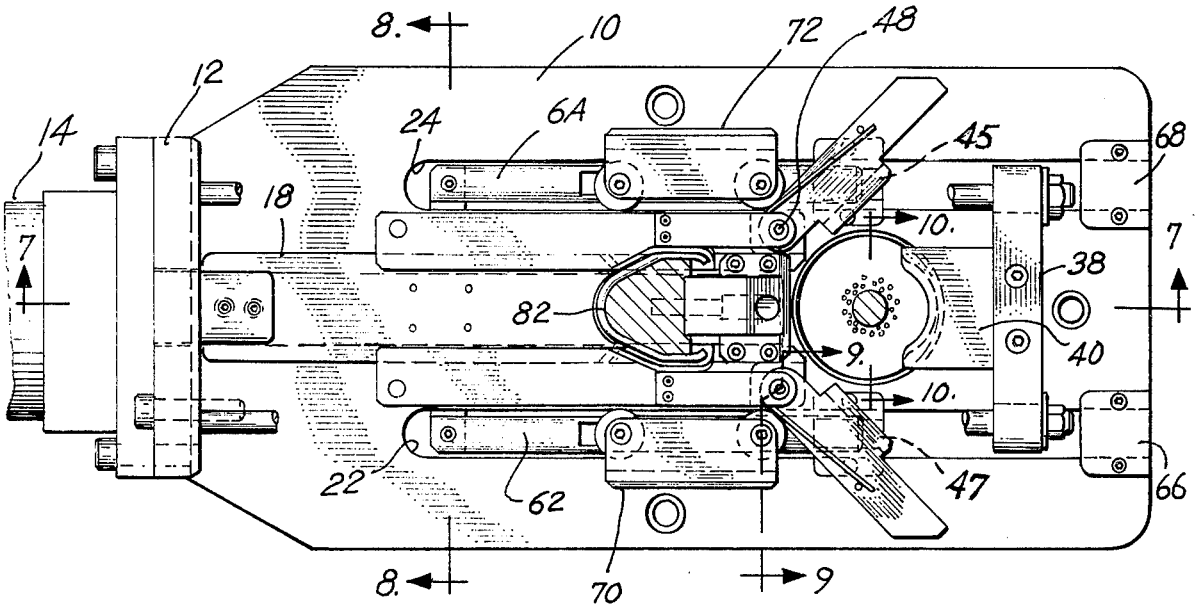
FIG. 5 is a plan view of the improved apparatus of the present invention wherein the punch is in the retracted position.

The clipping apparatus of the present invention includes a frame 10 with an attached head plate 12 for mounting a drive cylinder 14. The drive cylinder 14 includes a projecting drive rod 16 connected with a punch 18.

The frame 10 is a plate member which may be mounted on an appropriate assembly machine by bracket means (not shown) in a manner familiar to those skilled in the art in order that the clipping apparatus may be utilized for performing a step in a manufacturing process. The frame 10 includes a generally circular opening 20. The opening 20 is positioned substantially at the center portion of the frame 10 in a path of travel defined by descending movement of the punch 18.

First and second slots 22 and 24 are also defined in frame 10. Slots 22 and 24 are parallel to each other and also are parallel to the direction of travel of the punch 18. The slots 22 and 24 are disposed on opposite sides of the opening 20 for reasons to be discussed in greater detail below.

Figure 6:
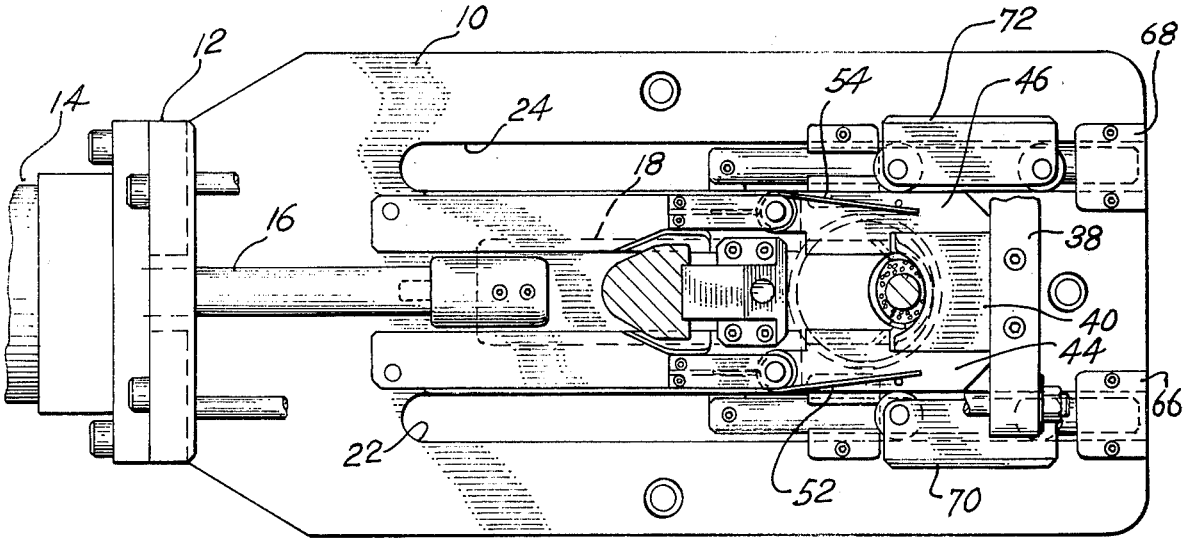
FIG. 6 is a plan view similar to FIG. 5; however, the punch has been projected to the driving position to attach the clip about the mass of material within the opening of the clipping device.
Figure 8:
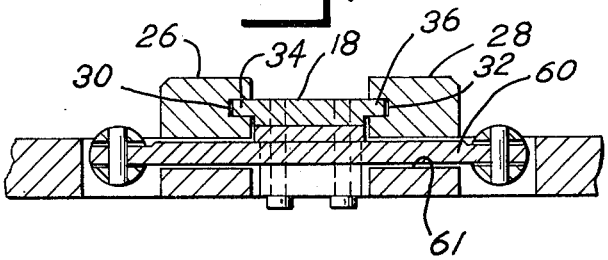
FIG. 8 is a cross-sectional view taken substantially along the line 8—8 in FIG. 5.

Positioned on opposite sides of the punch 18 for cooperation therewith are first and second channel bars 26 and 28 respectively. The channel bars 26 and 28 act as guide means and define a guideway for the punch 18. As shown in FIG. 8, channels 30 and 32 defined in the channel bars 26 and 28 respectively define a guideway for the punch 18. The punch 18 includes cooperative outwardly extending flanges 34 and 36 received by the channels 30 and 32 respectively. The punch 18 thus slides in the guideway defined, at least in part, by channel bars 26 and 28 between a retracted position illustrated in FIGS. 1, 5 and 12 and a driving position illustrated in FIGS. 6 and 13.

Figure 10:
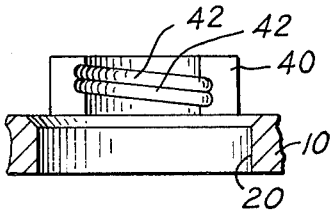
FIG. 10 is a cross-sectional view taken substantially along the line 10—10 in FIG. 5.

Also mounted on the frame 10 opposite the punch 18 and adjacent the opening 20 is a die plate 38. A die 40 is, in turn, attached to the die plate 38. The die 40 includes channels or grooves 42 in FIG. 10 adapted to cooperate with a clip 82 to form that clip 82 about a mass of material in opening 20. Generally, the grooves 42 comprise arcuate channels having a common axis of rotation and a common radius, disposed in side-by-side relationship on the die 40.

First and second gate members 44 and 46 are pivotally attached to the frame 10 and channel bars 26 and 28 by means of pivot posts 48 and 59 respectively. Torsion springs 52 and 54 encircle posts 48 and 50 respectively and include an extension 56 and 58 to bias the gate members 44 and 46 outwardly away from the opening 20 to a position illustrated in FIG. 12.

Figure 9:
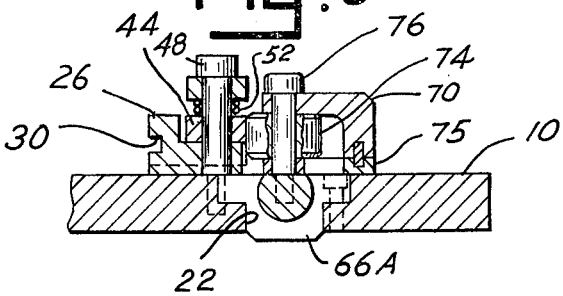
FIG. 9 is a cross-sectional view taken substantially along the line 9—9 in FIG. 5.

An actuating mechanism for the gate members 44 and 46 is coupled with the punch 18. The gate actuating mechanism includes a cross bar member 60 which is attached to the punch 18 as illustrated in FIG. 8. The opposite ends of the cross bar member 60 are attached to rods 62 and 64 respectively as illustrated in FIGS. 5, 6, 12 and 13. The lower end of each rod 62 and 64 respectively is mounted for sliding movements in a bushing 66 and 68 respectively. Intermediate support bushings 66A and 68A are also provided for each rod 62 and 64 respectively as shown in FIGS. 5, 6, 9, 12 and 13. The bushings 66 and 68 are fixed to the frame 10 at the lower ends of slots 22 and 24 respectively. The bushings 66A and 68A are also fixed in slots 21 and 24 respectively as illustrated in FIG. 9. Thus, driving the punch 18 by the piston 14 will cause the cross bar 60 and attached rods 62 and 64 to move with the punch 18. It will be noted that the cross bar member 60 fits within a slot 61 defined in the channel bars 26 and 28. Thus, as the punch 18 is moved downwardly relative to the channel bars 26 and 28, the cross bar member 60 and attached rods 62 and 64 move downwardly in unison.

Figure 12:
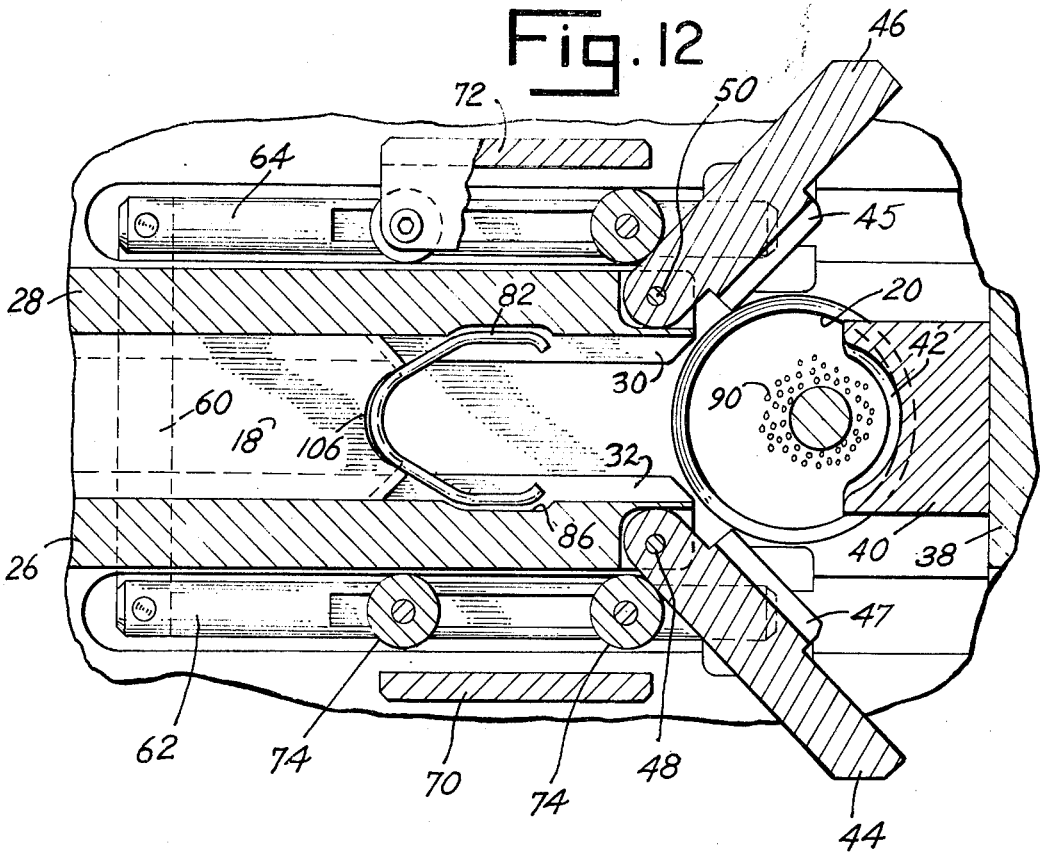
FIG. 12 is a cross-sectional view of the clipping apparatus taken substantially along the line 12—12 in FIG. 7.
Figure 13:
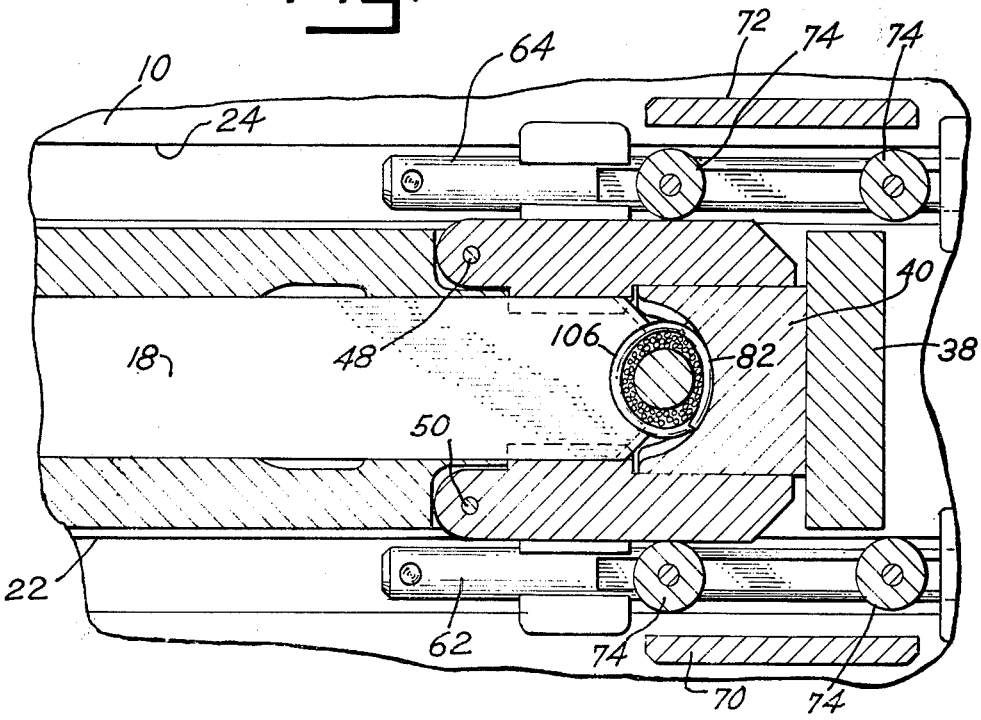
FIG. 13 is a cross-sectional view similar to FIG. 12 wherein the punch mechanism has been driven to engage the clip and close the gate members.
Figure 14:
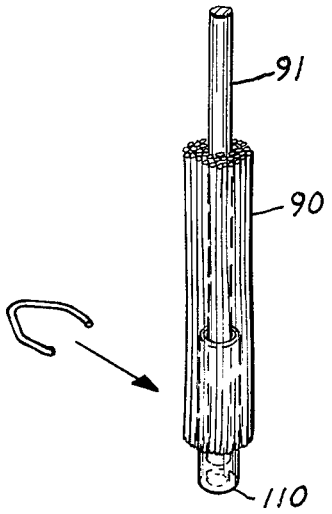
FIGS. 14, 15, 16 and 17 illustrate another embodiment of a product made in accordance with the process and product of the invention.

Gate actuators 70 and 72 are attached to the rods 62 and 64 respectively. Actuators 70 and 72 include cam rollers 74 mounted on pins 76. The pins also serve to attach the actuators 70 and 72 to the rods 62 and 64 as illustrated in FIG. 9, maintaining a bushing pad 75 in contact with the surface of frame 10. The rollers 74 are thus engageable with the outside edge of the gate members 44 and 46, as illustrated in FIGS. 12 and 13 as actuators 70 and 72 slide on frame 10 in unison with movement of rods 62 and 64.

Figure 7:
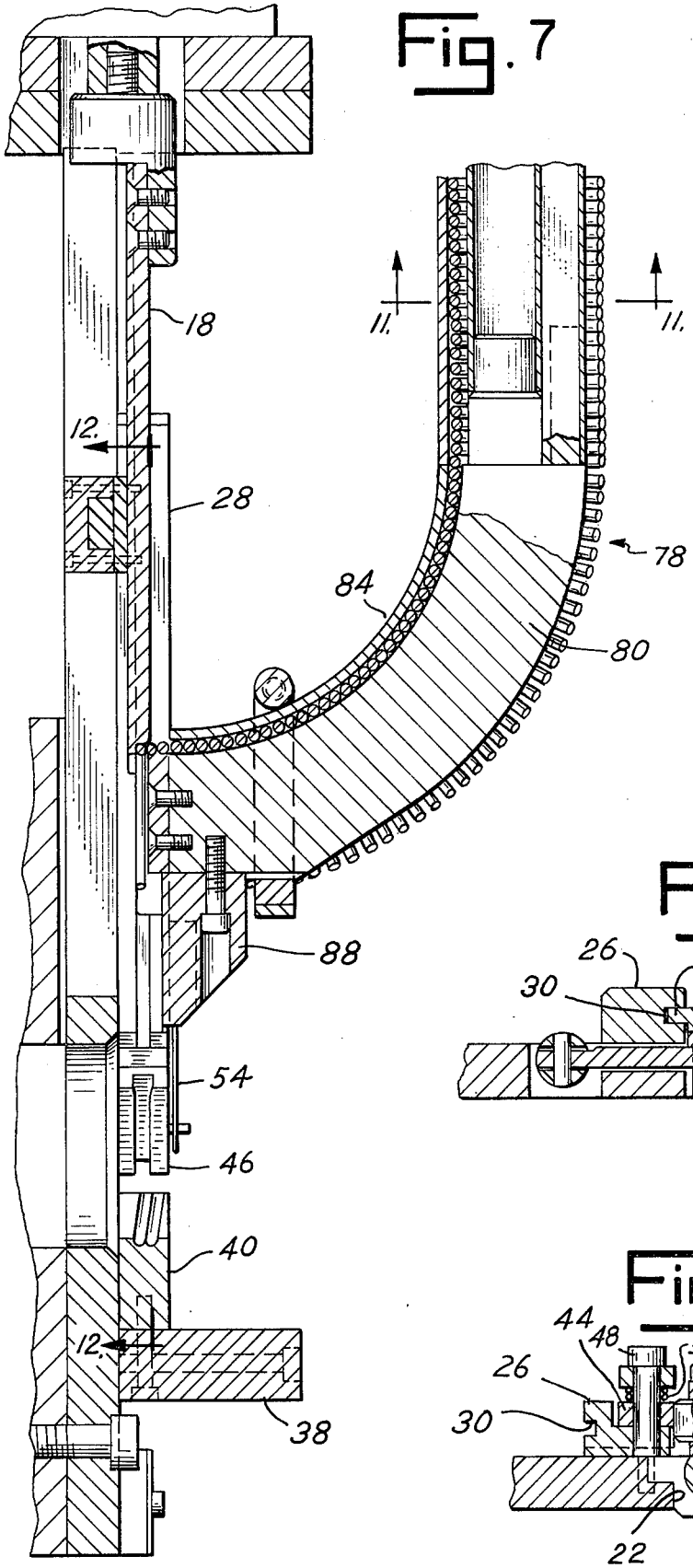
FIG. 7 is a cross-sectional view of apparatus of the present invention taken substantially along the line 7—7 in FIG. 5.
Figure 11:
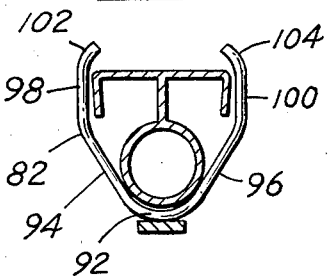
FIG. 11 is a cross-sectional view of the clip magazine and feed means taken substantially along the line 11—11 in FIG. 7.

A clip magazine 78 is also provided as more clearly illustrated in FIGS. 7 and 11. The clip magazine 78 is comprised of a rail 80 upon which a plurality of clips are arranged. The clips 82 are maintained in alignment on the rail 80 by a rail guard 84. The rail 80 is curved downward so that clips 82 may be guided into a slot or notch 86 defined by the channel bars 26 and 28 in FIG. 12. The rail 80 is attached to a mounting block 88 in FIG. 12. The rail 80 is attached to a mounting block 88 in FIG. 7 which, in turn, spans and is attached to the channel bars 26 and 28. The mounting block 88 thus bridges the space between the channel bars 26 and 28 to permit positioning of a clip window or clip nest area.

Referring again to FIG. 12, once a clip 82 is positioned in a window, notch or nest 86 intermediate the channel bars 26 and 28, it is in position for engagement by the punch 18 is slidably mounted in the channels 30 and 32. The width of the punch 18 is substantially equal to the width of the clip 82. Additionally, the gate members 44 and 46 include a cross-sectional form or channels 45 and 47 respectively in FIGS. 5 and 12 identical to the channels 30 and 32 of bars 26 and 28 so that a single continuous channel 30–45 and 32–47 is formed along the length of the path of travel on each side of the punch 18 to the die 40 by actuation or closing of the gate members 44 and 46 by the gate actuators 70 and 72. In this manner, a total channel is provided for guiding the clip 82 about a mass of material 90 in the opening 20 for cooperation with die 40.

As shown in FIG. 11, the clip 82 is comprised of an arcuate crown portion 92 with outwardly projecting runs or extensions 94 and 96 forming an acute angle with each other. The extensions 94 and 96 connect with parallel legs 98 and 100 respectively. The legs 98 and 100 terminate as inwardly curved ends 102 and 104. The inwardly curved ends 102, 104 are especially important to insure that the ends 102, 104 will be projected into the mass of material 90 without any sharp external projections. Only the smooth outer surface of the clip 82 will be exposed because of this feature.

The diameter of the arcuate crown 92 is substantially equal to the diameter of the finished product resulting from the attachment of the clip to the mass of material 90 or alternatively the diameter of the rod-like material. This diameter is shown in FIG. 13. Note that this diameter is also substantially equal to the diameter at the lower end 106 of the punch 18 as illustrated in more detail in FIG. 12. Moreover, the length of the arc of crown 92 is about equal to the arc of lower end 106. The legs 98 and 100 are spaced from one another by a distance slightly greater to the diameter of the mass of material 90 prior to attachment of the clip. This is also illustrated in FIG. 12 of the application. In the event the mass material 90 is semi-compressed prior to application of a clip, the spacing of logs 98 and 100 may be proportionally decreased also.

In operation, the mass of material 90, which typically may include a broomstick 91 and yarn 93, is inserted in the clipper device as shown in FIG. 12. Subsequently the piston 14 is operated. Simultaneously the actuators 70 and 72 are driven into engagement with the gate members 44 and 46 closing the gate members 44 and 46 and defining a channel for the clip 82. During the descent of the punch 18 after the gate members 44 and 46 are closed, the punch 18 engages the clip 82 which has been fed into the clip channel by means of the clip injector mechanism. The clip 82 is driven in the channel about the mass 90 and into cooperation with the die 40. This causes the clip 82 to form about the mass 90 as illustrated by FIG. 3 of the application. Subsequently the drive cylinder causes the punch 18 to be withdrawn and gates 44 and 46 retracted. The finished product may then be removed from the clipping apparatus as a finished product as shown typically in FIG. 4. Preferably, a second clip 108 in FIG. 4A is attached over the folded yarn or mass 90. Equivalent fastening means may be positioned in the place of clip 108. For example, cord or a heat shrinkable plastic may be used. Thus, the sequence of operation includes (1) combining the materials that will be eventually clipped as illustrated in FIG. 2, (2) positioning the material within the clipping apparatus, (3) attachment of the clip 82 to those materials, and (4) attachment of a second clip 108 or equivalent fastening means.

Figure 15:
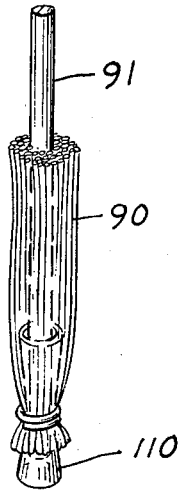
Figure 16:
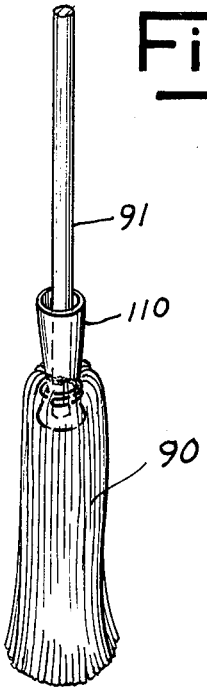
Figure 17:
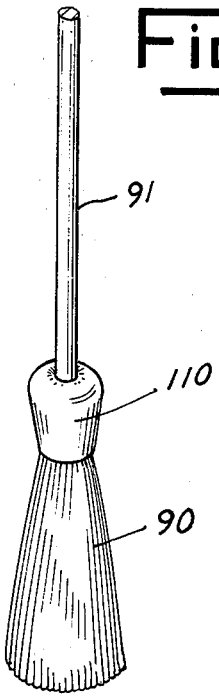

FIGS. 14–17 illustrate another method for manufacture within the scope of the invention. In this method, a sleeve 110 is fitted over the end of rod 91. The material 90 is attached as previously described by a clip 82. This is shown in FIG. 15. Subsequently, the sleeve 110 is folded back over itself as shown in FIG. 17. Note that clip 82 must be applied in such a manner that permits sleeve 110 to be exposed and folded over. Sleeve 110 may be formed of a plastic material, for example, and may be heat shrinkable. With this configuration, the addition of a second clip 108 is not required.

This apparatus is especially useful in the instance where a rather large mass of material must be clipped. Additionally, the large mass of material may be, at least in part, not compressible. Though the description refers to a rod-like member, the cross-sectional shape of the rod is not known to be a limiting feature of the invention.

Also the particular structure of the apparatus of the invention is not a limiting feature. That is, the frame may be comprised of a number of separate parts. The opening 20 may merely be defined by adjacent members rather than as a passage in a plate. Thus the invention shall be limited only by the following claims and their equivalents.

What is claimed is:

1. Apparatus for attaching a clip about a mass comprising, in combination:

a mounting structure defining an opening for receipt of said mass, guide means on the mounting structure transverse to the axis of the opening;

punch means mounted in said guide means for reciprocation between a retracted position and a clip driving position;

clip magazine means mounted for inserting a single clip into said guide means in the path of travel of said punch means when in the retracted position;

die means mounted on the opposite side of the opening from said punch means;

first and second opposed gate members on opposite sides of said opening intermediate said die and punch means, said gate members pivotally attached with said guide means and extensible along the sides of said opening between said guide means and said die means to form a complete, closed channel for said clip and punch means;

first and second gate actuators mounted on said structure for translation parallel with said punch means to engage said first and second gate members respectively and drive said gate members to a closed position in response to travel of the punch means from the retracted toward the clip driving position; and means for driving said punch means.

2. Apparatus of claim 1 including biasing means to normally maintain said gate members pivoted outwardly away from said opening for access to said opening.

3. The improvement of claim 1 wherein said gate members are pivotal about parallel axes on the side of the opening opposite the die means.

4. Apparatus of claim 1 including a channel slot defined in said guide means and said gate members for receipt and guiding both said clip and said punch means.

5. The apparatus in claim 1 wherein said clip magazine means comprises a clip rail positioned to receive a plurality of aligned clips thereon, one end of said rail terminating adjacent a channel defined in said guide means for receipt of said punch means, said rail positioned to discharge a clip having a crown in the channel in the path of the punch means whereby the punch means may engage the crown of said clip and drive said clip through said guide means and into contact with said die means about said mass.

6. The apparatus of claim 1 including a cross member attached to said punch means and having its opposite ends also attached to said first and second gate actuators whereby said punch means and said gate actuators are driven in unison by said means for driving said punch means, said cross member being mounted for sliding movement in said guide means between the retracted and driving position of said punch means.

7. The apparatus of claim 1 wherein said first and second gate actuators each comprise a cam member positioned to engage said gate member and move said gate member about its pivot axis in response to translational movement of said gate actuator.

8. The apparatus of claim 1 including a clip in said guide means said clip having an arcuate crown engaged by an arcuate edge defined at the driving end of the punch means, said clip also including outwardly extending runs from said crown forming an acute angle and subsequent parallel spaced legs, said legs being spaced a distance substantially equal to or greater than the size of the mass being clipped prior to attachment of the clip, the diameter of the crown being substantially equal to the diameter of the material subsequent to attachment of the clip.

9. The apparatus of claim 8 wherein said clipped legs terminate with in-turned ends adapted to cooperate with die means, form a generally circular clip about the mass and project into the mass in order to eliminate external clip protrusions.

10. The apparatus of claim 1 wherein said punch means comprises a punch having an arcuate driving edge for engagement with the arcuate crown of a clip, said punch driving portion having a diameter substantially equal to the diameter of the material being clipped upon attachment of the clip thereto, said diameter being less than the total width of the punch.

* * * * *